US008726949B1

(12) United States Patent
Poire et al.

(10) Patent No.: US 8,726,949 B1
(45) Date of Patent: May 20, 2014

(54) ATTACHABLE FUNNEL SYSTEM FOR SUPPORTING FOOD CONTAINERS

(75) Inventors: Robert J. Poire, Meredith, NH (US); Lynda Niles-Poire, Meredith, NH (US)

(73) Assignee: Robert J. Poire, Meredith, NH (US)

( * ) Notice: Subject to any disclaimer, the term of this patent is extended or adjusted under 35 U.S.C. 154(b) by 353 days.

(21) Appl. No.: 13/238,584

(22) Filed: Sep. 21, 2011

(51) Int. Cl.
*B67C 11/02* (2006.01)

(52) U.S. Cl.
CPC ..... *B67C 11/02* (2013.01)
USPC ..... 141/338; 141/340

(58) Field of Classification Search
CPC ..... B67C 11/00; B67C 11/02
USPC ..... 141/330–345
See application file for complete search history.

(56) References Cited

U.S. PATENT DOCUMENTS

| | | | | | |
|---|---|---|---|---|---|
| 292,629 | A | * | 1/1884 | Doty | 141/340 |
| 853,427 | A | * | 5/1907 | Stoewsand | 141/340 |
| 1,484,357 | A | | 2/1924 | Mullen | |
| 2,024,168 | A | * | 12/1935 | Kneer | 141/344 |
| 2,054,265 | A | | 9/1936 | Muguerditchian | |
| 2,058,925 | A | * | 10/1936 | Tompkins | 141/340 |
| 2,144,923 | A | * | 1/1939 | Kester et al. | 141/340 |
| 2,517,759 | A | * | 8/1950 | Bentzen | 141/340 |
| 2,703,670 | A | * | 3/1955 | Voight | 141/340 |
| D244,171 | S | | 5/1977 | Pearce | |
| D341,149 | S | * | 11/1993 | Pollak | D15/150 |
| 5,385,180 | A | | 1/1995 | Wittman | |
| 5,655,580 | A | | 8/1997 | Schrock | |
| 5,899,246 | A | * | 5/1999 | Cummins et al. | 141/340 |
| 6,116,299 | A | | 9/2000 | Cummins et al. | |
| 7,270,159 | B2 | * | 9/2007 | Burns | 141/340 |
| 7,461,542 | B2 | * | 12/2008 | Weisinger | 141/331 |
| 7,975,734 | B2 | * | 7/2011 | Makowiec et al. | 141/340 |
| 8,109,399 | B1 | * | 2/2012 | Sheffield et al. | 141/340 |
| 2002/0007866 | A1 | * | 1/2002 | Swan | 141/340 |
| 2004/0154696 | A1 | | 8/2004 | Koncelik, Jr. et al. | |
| 2006/0144465 | A1 | * | 7/2006 | Burns | 141/340 |
| 2010/0154929 | A1 | * | 6/2010 | Makowiec et al. | 141/340 |
| 2011/0011488 | A1 | * | 1/2011 | Sickler | 141/340 |
| 2011/0308667 | A1 | * | 12/2011 | Gallegos | 141/340 |

* cited by examiner

*Primary Examiner* — Gregory Huson
*Assistant Examiner* — Nicolas A Arnett
(74) *Attorney, Agent, or Firm* — Michael J. Pebsa; Catherine E. Napjus; Lawson Pebsa & Weldon-Francke

(57) ABSTRACT

A funnel system having a funnel with a side wall with a top edge and a bottom edge, a first hook and a second hook each on an outer surface of the side wall of the funnel, the hooks are aligned along an axis parallel to the top edge of the funnel, the hooks are spaced a first distance apart, the first distance is an arc length formed between the hooks, a stabilizer bar on the outer surface of the side wall of the funnel, the stabilizer bar having a horizontal bar connected to a vertical bar at a first angle, the first angle is about 90 degrees, wherein a top end of the vertical bar is attached to the side wall of the funnel and a second end of the horizontal bar is attached to the side wall of the funnel below the top end of the vertical bar.

8 Claims, 3 Drawing Sheets

TOP VIEW

ALT. EMBODIMENT

ATTACHABLE FUNNEL SYSTEM FOR SUPPORTING FOOD CONTAINERS

FIELD OF THE INVENTION

The present invention is directed to a cooking accessory, more particularly to a funnel attachable to a cooking apparatus for supporting upside down food containers such as bottles, cans, and jars.

BACKGROUND OF THE INVENTION

Getting the entire volume of food out of a jar, can, or bottle can be difficult. Many individuals spend time shaking the bottle upside down until the remaining food slides out of the bottle or use their fingers or a spatula to scoop out remaining food. Some individuals simply throw the extra food in the garbage. The present invention features an attachable funnel system for supporting a bottle, can, or jar so that food can slide into a pot, measuring cup, bowl, or other cooking apparatus. The system easily clips to the side of the cooking apparatus.

SUMMARY

The present invention features an attachable funnel system for supporting food containers. In some embodiments, the funnel system comprises a funnel having a side wall with a top edge and a bottom edge; a first hook and a second hook each disposed on an outer surface of the side wall of the funnel, the hooks are aligned along an axis parallel to the top edge of the funnel, the hooks are spaced a first distance apart, the first distance is an arc length formed between the hooks; a stabilizer bar disposed on the outer surface of the side wall of the funnel, the stabilizer bar comprises a horizontal bar connected to a vertical bar at a first angle, the first angle is about 90 degrees, wherein a top end of the vertical bar is attached to the side wall of the funnel and a second end of the horizontal bar is attached to the side wall of the funnel below the top end of the vertical bar.

In some embodiments, the funnel is cone-shaped. In some embodiments, the funnel is dome-shaped. In some embodiments, the first hook and the second hook are each disposed on the side wall of the funnel at the top edge of the funnel.

In some embodiments, the first distance is between about 1 to 4 inches. In some embodiments, the first distance is between about 4 to 10 inches. In some embodiments, the stabilizer bar is relatively positioned in between the first hook and the second hook.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
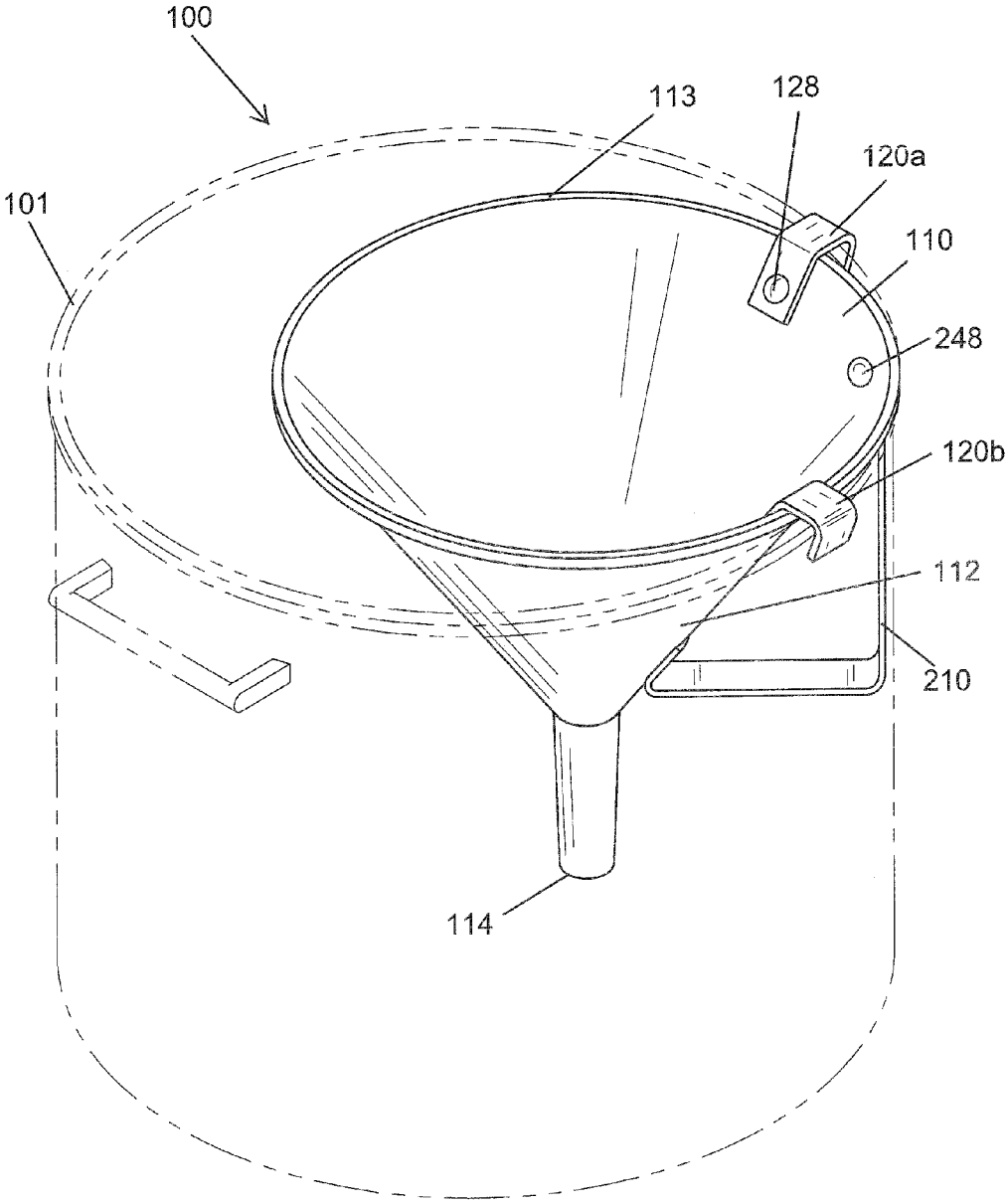
FIG. 1 is an in-use view of the system of the present invention.
Figure 2:
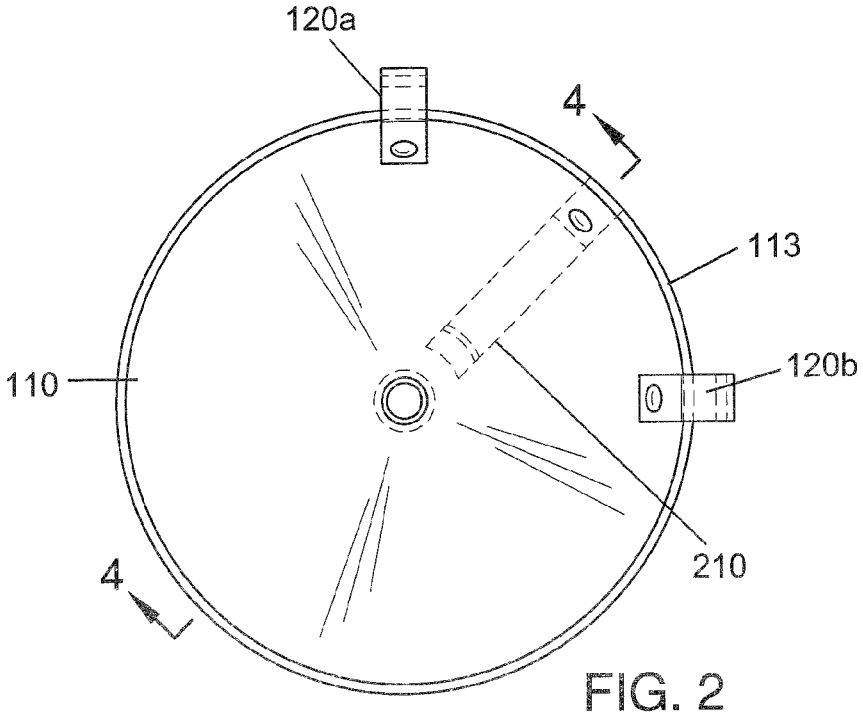
FIG. 2 is a top view of the system of the present invention.
Figure 3:
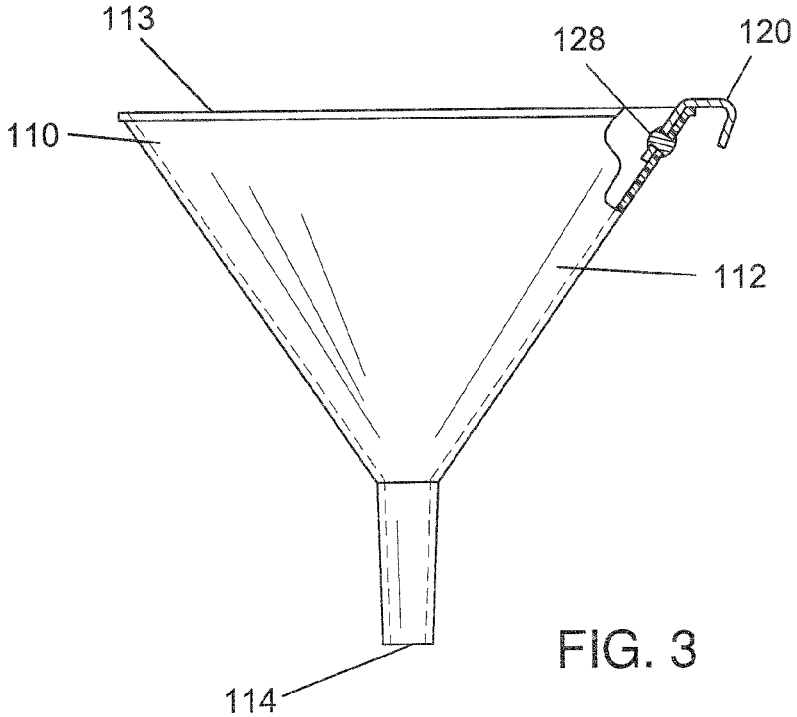
FIG. 3 is a side view of the system of the present invention.
Figure 4:
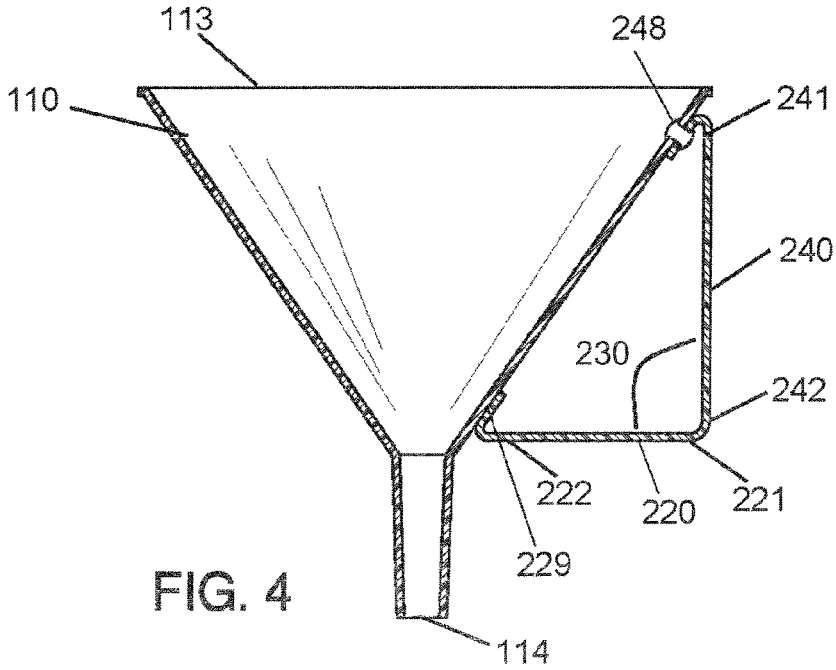
FIG. 4 is a side cross sectional view of the system of the present invention.

Referring now to FIG. 1-5, the present invention features an attachable funnel system 100 for supporting a bottle, can or jar so that food can slide into a pot, measuring cup, bowl, or other cooking apparatus. The system 100 of the present invention may be constructed in a variety of styles, designs, and colors.

The system 100 of the present invention comprises a funnel 110. The funnel 110 may resemble standard funnels, which are well known to one of ordinary skill in the art. For example, the funnel 110 has an enclosure formed by a side wall 112 with a top edge 113 and a bottom edge 114. The top edge 113 is wider (e.g., has a larger diameter) than the bottom edge 114. Material can be poured into the enclosure and funneled through the hole or aperture surrounded by the bottom edge 114.

Figure 5:
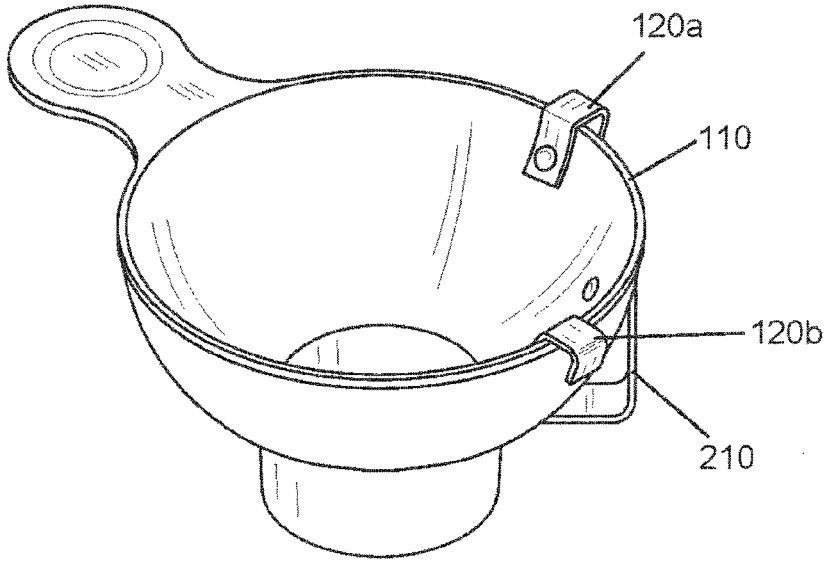
FIG. 5 is a perspective view of an alternative embodiment of the system of the present invention.

The funnel 110 may be constructed in a variety of shapes and configurations. For example, as shown in FIG. 1-4, the funnel 110 may be generally cone-shaped. As shown in FIG. 5, the funnel 110 may be generally dome-shaped. The funnel 110 is not limited to the shapes described herein.

Disposed on the side wall 112 of the funnel 110 at or near the top edge 113 (and extending outwardly from the side wall 112) is a first hook 120*a*. In some embodiments, a second hook 120*b* is disposed side wall 112 of the funnel 110 at or near the top edge 113 (and extending outwardly from the side wall 112). The hooks 120 function to allow the funnel 110 to be hung on a cooking apparatus, for example a pot 101 (e.g., the edge of the pot 101) or bowl or the like as shown in FIG. 1. The hooks 120 are aligned along an axis parallel to the top edge 113 of the funnel 110. For example, the hooks 120 are aligned such that the hooks 120 are the same distance downwardly from the top edge 113 of the funnel 110.

The hooks 120 may be spaced a first distance apart, the first distance referring to the arc length of the arc formed between the hooks 120. In some embodiments, the first distance is between about 1 to 2 inches. In some embodiments, the first distance is between about 2 to 4 inches. In some embodiments, the first distance is between about 4 to 6 inches. In some embodiments, the first distance is between about 6 to 8 inches. In some embodiments, the first distance is between about 8 to 10 inches. In some embodiments, the first distance is between about 10 to 12 inches. In some embodiments, the first distance is between about 12 to 15 inches. In some embodiments, the first distance is greater than about 15 inches.

In some embodiments, the hooks 120 are attached via a first attachment means. The first attachment means may comprise any appropriate attachment means including but not limited to a rivet 128, an adhesive, welding, the like, or a combination thereof.

Disposed on the side wall 112 (e.g., the outer surface of the side wall 112) of the funnel 110 is a stabilizer bar 210. In some embodiments, the stabilizer bar 210 is relatively positioned in between the first hook 120*a* and the second hook 120*b*. In some embodiments, a portion of the stabilizer bar 210 is positioned directly in between the first hook 120*a* and the second hook 120*b*. The stabilizer bar 210 functions to hold the funnel upright when the funnel 110 is hooked to the edge of the cooking apparatus (e.g., pot 101). The stabilizer bar 210 comprises a horizontal bar 220 connected to a vertical bar 240 at a first angle 230. In some embodiments, the first angle 230 is about 90 degrees. In some embodiments, the first angle 230 is between about 80 to 100 degrees. In some embodiments, the first angle 230 is between about 70 to 110 degrees. The top end 241 of the vertical bar 240 is attached to the side wall 112 (e.g., at or near the top edge 113) of the funnel 110 via a second attachment means. The bottom end 242 of the vertical bar 240 is attached to the first end 221 of the horizontal bar 220. The second end 222 of the horizontal bar 220 is attached to the side wall 112 of the funnel 110 below the position of the top end 241 of the vertical bar 240 via a third attachment means. When in use, the vertical bar 240 typically contacts the side wall of the cooking apparatus (e.g., pot 101) to help keep the funnel 110 upright.

The second attachment means may comprise any appropriate attachment means including but not limited to a rivet 248, an adhesive, welding, the like, or a combination thereof. The third attachment means may comprise any appropriate attachment means including but not limited to a rivet, an adhesive 229, welding, the like, or a combination thereof.

The system 100 of the present invention may be constructed in a variety of sizes. For example, in some embodiments, the top edge 113 of the funnel 110 is between about 5 to 8 inches in diameter. In some embodiments, the top edge 113 of the funnel 110 is between about 8 to 10 inches in diameter. In some embodiments, the top edge 113 of the funnel 110 is between about 10 to 15 inches in diameter. In some embodiments, the top edge 113 of the funnel 110 is between about 15 to 20 inches in diameter. The system 100 of the present invention is not limited to the aforementioned dimensions.

As used herein, the term "about" refers to plus or minus 10% of the referenced number. For example, an embodiment wherein the top edge 113 of the funnel 110 is about 10 inches in diameter includes a top edge 113 that is between 9 and 11 inches in diameter.

The disclosures of the following U.S. Patents are incorporated in their entirety by reference herein: U.S. Pat. No. 1,484,357; U.S. Pat. No. 2,054,265; U.S. Design Pat. No. D244171; U.S. Pat. No. 5,385,180; U.S. Pat. No. 5,655,580; U.S. Pat. No. 6,116,299; U.S. Patent Application No. 2004/0154696.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A funnel system comprising:

(a) a funnel having a side wall with a top edge and a bottom edge;

(b) a first downward facing hook and a second downward facing hook each disposed on an outer surface of the side wall of the funnel and extending outwardly, the hooks are aligned along an axis parallel to the top edge of the funnel, the hooks are spaced a first distance apart, the first distance is an arc length formed between the hooks, wherein the downward direction is toward the bottom edge;

(c) a stabilizer bar disposed on the outer surface of the side wall of the funnel, the stabilizer bar comprises a horizontal bar connected to a vertical bar at a first angle, the first angle is about 90 degrees, wherein a top end of the vertical bar is attached to the side wall of the funnel at the top edge and a second end of the horizontal bar is attached to the side wall of the funnel below the top end of the vertical bar.

2. The system of claim 1, wherein the funnel is cone-shaped.

3. The system of claim 1, wherein the funnel is dome-shaped.

4. The system of claim 1, wherein the first hook and the second hook are each disposed on the side wall of the funnel at the top edge of the funnel.

5. The system of claim 1, wherein the first distance is between about 1 to 4 inches.

6. The system of claim 1, wherein the first distance is between about 4 to 10 inches.

7. The system of claim 1, wherein the stabilizer bar is relatively positioned in between the first hook and the second hook.

8. A funnel system consisting of:

(a) a funnel having a side wall with a top edge and a bottom edge;

(b) a first downward facing hook and a second downward facing hook each disposed on an outer surface of the side wall of the funnel and extending outwardly, the hooks are aligned along an axis parallel to the top edge of the funnel, the hooks are spaced a first distance apart, the first distance is an arc length formed between the hooks, wherein the downward direction is toward the bottom edge;

(c) a stabilizer bar disposed on the outer surface of the side wall of the funnel, the stabilizer bar consists of a horizontal bar connected to a vertical bar at a first angle, the first angle is about 90 degrees, wherein a top end of the vertical bar is attached to the side wall of the funnel at the top edge and a second end of the horizontal bar is attached to the side wall of the funnel below the top end of the vertical bar.

* * * * *